US007207694B1

(12) United States Patent
Petrick

(10) Patent No.: US 7,207,694 B1
(45) Date of Patent: Apr. 24, 2007

(54) LIGHT EMITTING DIODE OPERATING AND EXAMINATION LIGHT SYSTEM

(75) Inventor: John T. Petrick, New Port Richey, FL (US)

(73) Assignee: Boyd Industries, Inc., Clearwater, FL (US)

( * ) Notice: Subject to any disclaimer, the term of this patent is extended or adjusted under 35 U.S.C. 154(b) by 0 days.

(21) Appl. No.: 10/922,697

(22) Filed: Aug. 20, 2004

(51) Int. Cl.
*F21V 1/00* (2006.01)

(52) U.S. Cl. ..... 362/240; 362/399; 362/804; 607/88

(58) Field of Classification Search ..... 362/249, 362/231, 235, 241, 225, 431, 418–420, 804, 362/572, 573, 543–546, 250; 607/88; 600/249
See application file for complete search history.

(56) References Cited

U.S. PATENT DOCUMENTS 4,254,453 A * 3/1981 Mouyard et al. ..... 362/240
4,271,408 A * 6/1981 Teshima et al. ..... 345/83
4,930,058 A * 5/1990 Jones et al. ..... 362/400
4,993,825 A * 2/1991 Abe et al. ..... 351/210
5,138,782 A * 8/1992 Mizobe ..... 40/541
5,634,287 A * 6/1997 Lamparter ..... 40/572
5,636,057 A * 6/1997 Dick et al. ..... 359/625
6,471,716 B1 * 10/2002 Pecukonis ..... 607/89
6,527,411 B1 * 3/2003 Sayers ..... 362/245
2003/0185009 A1 * 10/2003 Walters ..... 362/276
2004/0001344 A1 * 1/2004 Hecht ..... 362/555
2004/0122492 A1 * 6/2004 Harth et al. ..... 607/88
2005/0094393 A1 * 5/2005 Czajkowski ..... 362/247

* cited by examiner

*Primary Examiner*—John Anthony Ward
*Assistant Examiner*—Gunyoung T. Lee
(74) *Attorney, Agent, or Firm*—Edward P. Dutkiewicz

(57) ABSTRACT

A light emitting diode light system has a plurality of light emitting diodes, a focusing member secured at a fixed distance from the light emitting diodes, and a substrate with a central section in a generally rectangular configuration securing the diodes in a common plane whereby light from the light emitting diodes is focused by the focusing member and projected to a patient for operating and examination purposes.

1 Claim, 6 Drawing Sheets

FIG 1
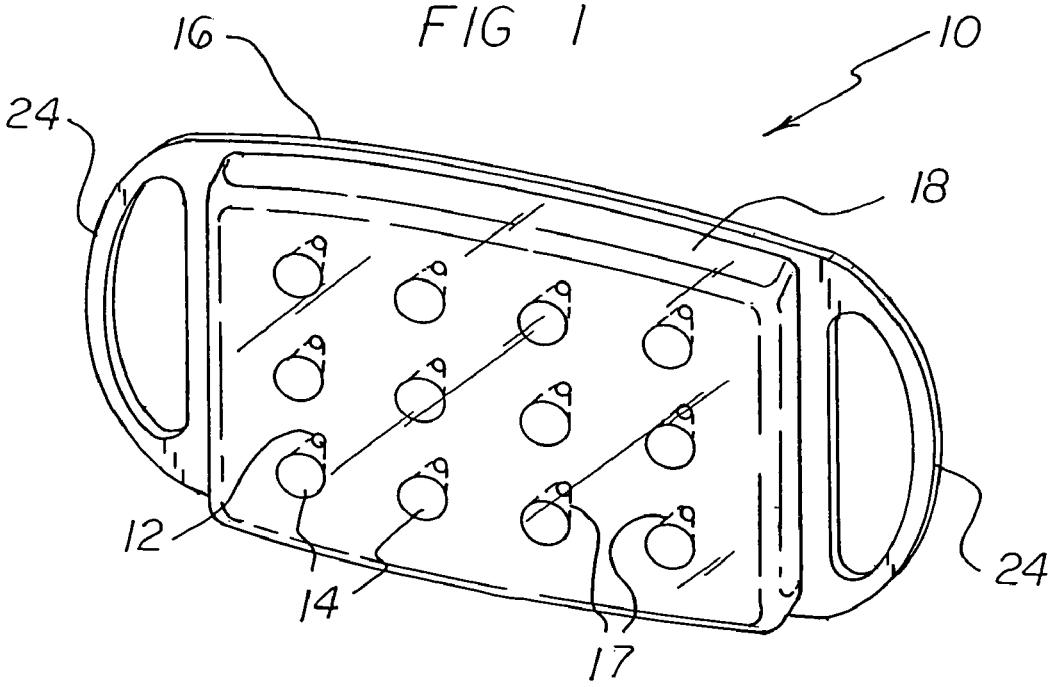
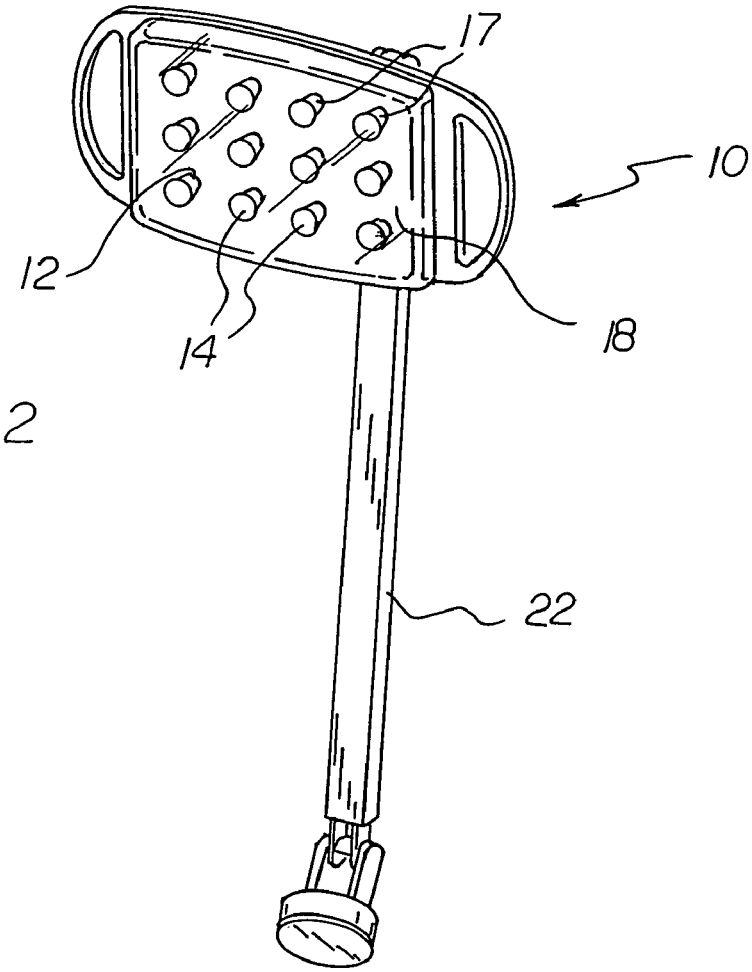
FIG 2

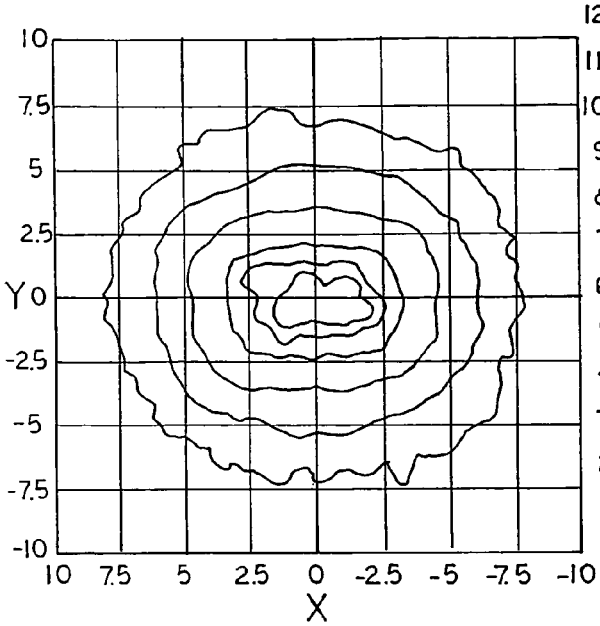
FIG 5
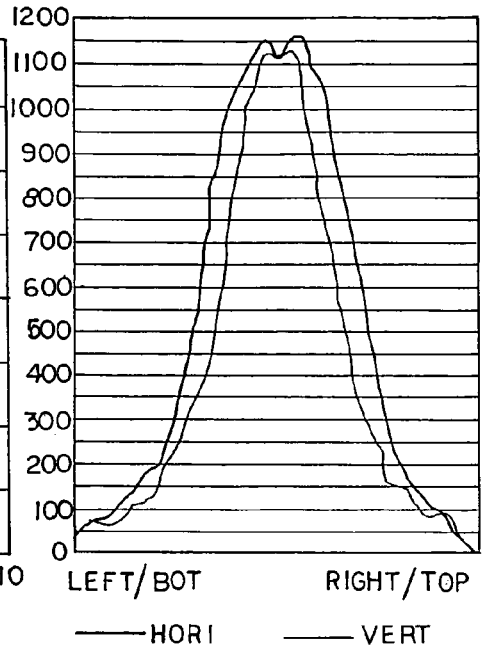
FIG 6
FIG 7
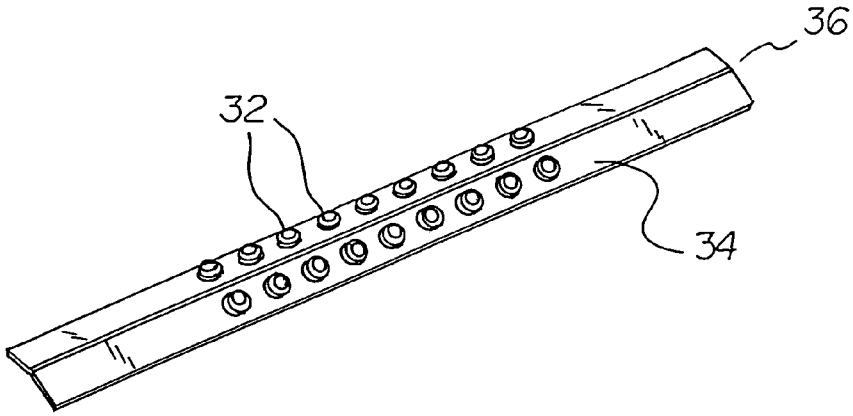

LIGHT EMITTING DIODE OPERATING AND EXAMINATION LIGHT SYSTEM

BACKGROUND OF THE INVENTION

1. Field of the Invention

The present invention relates to a light emitting diode operating and examination light system and more particularly pertains to illuminating an area for performance of a medical operating procedure and medical examination with minimum heat generated and energy required in association with maximum efficiency.

2. Description of the Prior Art

The use of operating and examination light systems of known designs and configurations is known in the prior art. More specifically, operating and examination light systems of known designs and configurations previously devised and utilized for the purpose of illuminating an area on a subject for performance of a medical operating procedure and medical examination are known to consist basically of familiar, expected, and obvious structural configurations, notwithstanding the myriad of designs encompassed by the crowded prior art which has been developed for the fulfillment of countless objectives and requirements.

By Way of Example, U.S. Pat. No. 4,316,237 to Yamada et al., Feb. 16, 1982, discloses a Lighting Fixture for Use in Medical Operations and Therapeutic Treatment. U.S. Pat. No. 4,380,794 to Lawson, Apr. 19, 1983, discloses a Surgical Lamp Characterized by Having an Improved Reflector. U.S. Pat. No. 4,608,622 to Gonser, Aug. 26, 1986, discloses a Multi-function Light Source. U.S. Pat. No. 4,630,182 to Moroi et al., Dec. 16, 1986, discloses an Illuminating System. U.S. Pat. No. 4,651,257 to Gehly, Mar. 17, 1987, discloses a Multiple Source Lighting Fixture. U.S. Pat. No. 4,288,844 to Fisher et Al., Sep. 8, 1981, discloses an Electrically Focused Surgical Light. U.S. Pat. No. 5,093,769 to Luntsford, Mar. 3, 1992, discloses a Surgical Lighting System. U.S. Pat. No. 5,274,535 to Gonser, Dec. 28, 1993, Discloses a Dental Operating Light with Color Correction. U.S. Pat. No. 5,580,163 to Johnson Ii, Dec. 3, 1996, discloses a Focusing Light Source with Flexible Mount for Multiple Light-emitting Elements. U.S. Pat. No. 4,254,454 to Hardin, Jr., Mar. 3, 1981, discloses a Self-ventilating Dental Lighting Device. U.S. Pat. No. 4,118,761 to Dey, Oct. 3, 1978, discloses a Light Condensing Illuminator. U.S. Pat. No. 3,704,928 to Coombs et Al., Dec. 5, 1972, discloses a Dental Light with Dichroic and Infrared Filters. U.S. Pat. No. 3,702,928 to Alger, Nov. 14, 1972, discloses an Adjustable Lighting Apparatus. U.S. Pat. No. 2,846,566 to F. Gunther et al., Aug. 5, 1958, discloses an Operating Table Lamp. U.S. Pat. No. 2,280,402 to E. H. Greppin, Apr. 21, 1942, discloses a Dental Operating Lamp. U.S. Pat. No. 2,088,024 to E. Baber, Jul. 27, 1937, discloses an Operating Room Lamp. U.S. Pat. No. 2,069,950 to E. H. Greppin, Feb. 9, 1937, discloses a Surgical Lamp.

A series of recent patents granted to Color Kinetics Inc., 10 Milk St. Suite 1100, Boston Mass. 02108 treats the combined use of microprocessor controlled colored LEDs to produce wide spectrum light including color corrected white light.

While these devices fulfill their respective, particular objectives and requirements, the aforementioned patents do not describe a light emitting diode operating and examination light system that allows illuminating an area for performance of a medical operating procedure and medical examination with minimum heat generated and energy required in association with maximum efficiency.

It is desirable to replace current medical operating and examination lights with versions employing light emitting diodes (LEDs) for the useful purposes of reducing electrical power consumption, extending lamp lifetime, and mitigating problems with heat generation in present fixtures. In addition, lighting systems employed in operating rooms where oxygen and various combustible gases, such as cyclopropane, may be used, should not incur an explosion hazard as is possible from exposed surface temperatures in excess of about 200 centigrade or in the event of an electrical spark as in igniting a high intensity discharge lamp. Current medical operating and examination lights susceptible to replacement by an LED version are widespread throughout the industry. These lights are currently available in units producing either a well defined pattern of illumination as in a dental version typically having a 24 inch projection distance forming a fixed rectangular illuminated area with little or no stray light hereinafter referred to as the high definition version, or a version illuminating a wider area of a patient over larger distances with lesser concern for stray light hereinafter referred to as a low definition version.

The prior art illumination light source for the high definition light is generally a single extended filament halogen lamp operating at about 150 watts. Light from the source is collected by a large shallow parabolic trough main reflector thereby generating a roughly rectangular illumination zone over a large range extending through the desirable 24-inch nominal working distance. Light emanating from the lamp not reaching the reflector is either blocked or is directed back through the parabola's focal line to be reflected by the main reflector toward the patient. Much of the input electrical power is converted into heat and must be dissipated using a heat transmitting glass reflector or other heat dissipation means. The high definition light is not a fixed light and is generally affixed to an articulated arm thereby permitting the medical practitioner to manually adjust the illuminated area of the patient. The high temperature of external parts associated with heat dissipation often creates an undesirable response should the practitioner inadvertently touch the main reflector or other hot parts of the light housing.

The prior art for the low definition light varies, but most frequently comprises a series of standard reflectorized halogen lamps, each known in the industry as an MR-16 operating at up to 75 watts power consumption. Higher output powers are available, however lifetime is reduced dramatically for lamps over 75 watts. A typical light employs four or more halogen MR-16 lamps. One arrangement comprises four MR-16 lamps affixed to a pair of substantially rectangular members crossing and joined at their centers. The MR-16 lamp can exhibit as much as 4,000 hours lifetime under ideally ventilated conditions, but it is generally known that in practical applications in a partial enclosure, particularly when the lamp is repositioned occasionally and cycled on and off repeatedly, the actual lifetime experienced is substantially less than 4,000 hours.

Significant savings in electrical power consumption and operating cost can be realized by providing LED based high definition and low definition lights for medical operating and examination purposes. It is the intent of this disclosure to describe techniques to introduce LEDs into the general operating and examination light art whereby less heat is generated and lamp lifetime is extended to enable operation for a minimum five-year period without lamp replacement. The principles and elements of this disclosure are not limited to a medical operating or examination lighting system, rather the concepts presented herein are extendible to broader classes of lights in even more general lighting applications.

Selected embodiments of the high and low definition operating and examination lights are outlined in the following. The number of LED sources needed to achieve usable illumination is a function of the state-of-the-art in LED technology. Generally the number of LEDs will not exceed thirty emitters at present. The use of LEDs emitting two or more different colors may be employed to provide color correction as well as color temperature changes more suitable for specific medical operating or examination applications.

In this respect, the light emitting diode operating and examination light system according to the present invention substantially departs from the conventional concepts and designs of the prior art, and in doing so provides an apparatus primarily developed for the purpose of illuminating an area for performance of a medical operating procedure and medical examination with minimum heat generated and energy required in association with maximum efficiency.

Therefore, it can be appreciated that there exists a continuing need for a new and improved light emitting diode operating and examination light system which can be used for illuminating an area for performance of a medical operating procedure and medical examination with minimum heat generated and energy required in association with maximum efficiency. In this regard, the present invention substantially fulfills this need.

SUMMARY OF THE INVENTION

In view of the foregoing disadvantages inherent in the known types of operating and examination light systems of known designs and configurations now present in the prior art, the present invention provides an improved light emitting diode operating and examination light system. As such, the general purpose of the present invention, which will be described subsequently in greater detail, is to provide a new and improved light emitting diode operating and examination light system and method which has all the advantages of the prior art and none of the disadvantages.

To attain this, the present invention essentially comprises a plurality of light emitting diodes. A lens, functioning as a focusing member, is positioned at a fixed common distance adjacent to each light emitting diode and a planar substrate with a rear face and a front face. The front face has a central section in a generally rectangular configuration securing the diodes in a common plane and forming rows and columns.

Next provided is a plurality of lens supports in a frustoconical configuration. Each support has a large end supporting an associated lens and a small end secured to the substrate and surrounding an associated light emitting diode. In this manner light from the light emitting diodes is focused by the lenses and projected to a patient for operating and examination purposes.

A protective cover is next provided. The cover is fabricated of a translucent material. A central portion in an rectangular configuration overlies the central section of the substrate. Four side portions couple the central portion to the substrate. The side portions include two parallel long side portions with two parallel short side portions there between. The side portions have a common height sufficient to allow the protective cover to totally encompass all of the light emitting diodes and their lenses and supports.

Next provided is a pair of laterally disposed cut out portions formed as extensions of the central section of the substrate adjacent to the two short side portions adapted to function as handles.

An articulated arm is next provided. The articulated arm extends in a generally vertical orientation during operation and use. The arm has an upper end and a lower end. The articulated arm includes a horizontal extension coupling the upper end of the articulated arm and the rear face of the substrate. The articulated arm also includes a disc shaped magnet pivotally coupled to the lower end of the articulated arm.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved light emitting diode operating and examination light system which has all of the advantages of the prior art operating and examination light systems of known designs and configurations and none of the disadvantages.

It is another object of the present invention to provide a new and improved light emitting diode operating and examination light system which may be easily and efficiently manufactured and marketed.

It is further object of the present invention to provide a new and improved light emitting diode operating and examination light system which is of durable and reliable constructions.

An even further object of the present invention is to provide a new and improved light emitting diode operating and examination light system which is susceptible of a low cost of manufacture with regard to both materials and labor, and which accordingly is then susceptible of low prices of sale to the consuming public, thereby making such light emitting diode operating and examination light system economically available to the buying public.

Even still another object of the present invention is to provide a light emitting diode operating and examination light system for illuminating an area for performance of a medical operating procedure and medical examination with minimum heat generated and energy required in association with maximum efficiency.

Lastly, it is an object of the present invention to provide a new and improved light emitting diode light system has a plurality of light emitting diodes, a focusing member secured at a fixed distance from the light emitting diodes, and a substrate with a central section in a generally rectangular configuration securing the diodes in a common plane whereby light from the light emitting diodes is focused by the focusing member and projected to a patient for operating and examination purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a light emitting diode operating and examination light system constructed in accordance with the principles of the present invention.

FIG. 2 is a perspective illustration of the light emitting diode operating and examination light system shown in FIG. 1 but mounted on an articulated arm.

FIG. 5 is a graph showing the dispersion of light from one of the Light emitting diodes through its associated lens.

FIG. 6 is a graph showing the magnitude of the light output from one of the Light emitting diodes through its associated lens.

FIG. 7 is a perspective illustration of a LED operating and examination light system constructed in accordance with an alternate embodiment of the present invention.

The same reference numerals refer to the same parts throughout the various Figures.

DESCRIPTION OF THE PREFERRED EMBODIMENT

Figure 3:
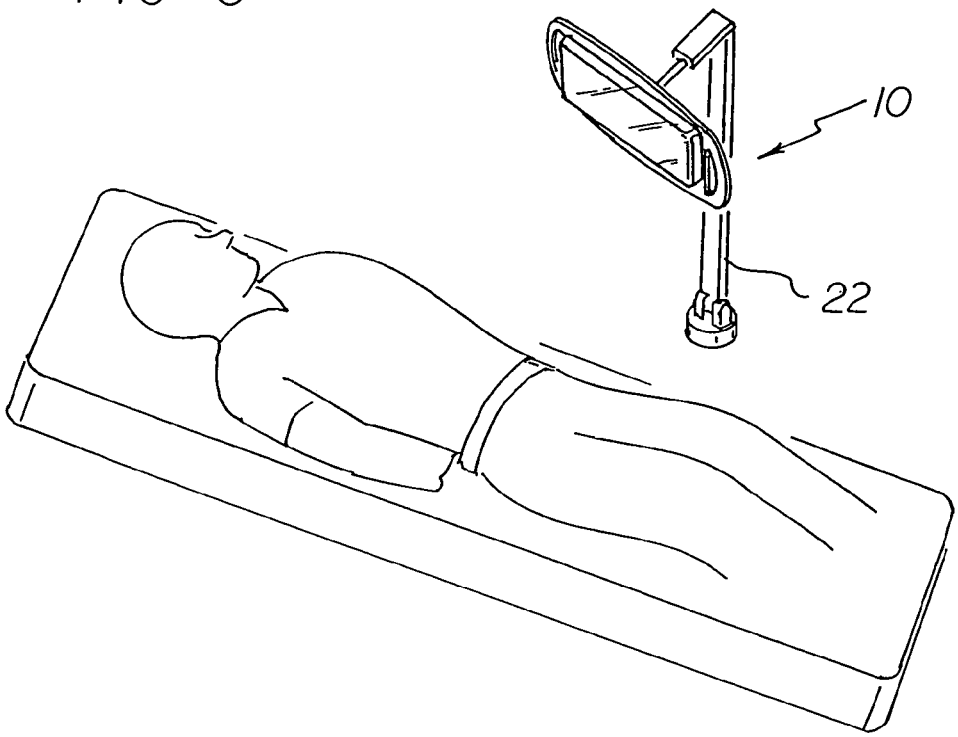
FIG. 3 is a perspective illustration of the Light emitting diode operating and examination light system mounted on an articulated arm as shown in FIG. 1 but positioned in proximity to a patient during operation and use.

This invention comprises the general concept of using one or more light emitting diodes, often referred to as LEDs, as a light source for illuminating an area on a subject for the performance of medical operating procedures or medical examinations. The light output from one of the embodiments of the invention illuminates a wide field suitable for operating room environments. The light output from another embodiment illuminates a smaller area providing a fixed illuminated region at a nominal working distance of about 24 inches.

With reference now to the drawings, and in particular to FIG. 1 thereof, the preferred embodiment of the new and improved light emitting diode operating and examination light system embodying the principles and concepts of the present invention and generally designated by the reference numeral 10 will be described.

The present invention, the light emitting diode operating and examination light system 10 is comprised of a plurality of components. Such components in their broadest context include a plurality of light emitting diodes, a focusing member, and a substrate. Such components are individually configured and correlated with respect to each other so as to attain the desired objective.

First provided is a plurality of light emitting diodes 12. A lens or reflector 14, functioning as a focusing member, is positioned at a fixed common distance adjacent to each light emitting diode and a planar substrate 16 with a rear face and a front face. The front face has a central section in a generally rectangular configuration securing the diodes in a common plane and forming rows and columns.

Next provided is a plurality of lens supports 17 in a frusto-conical configuration. Each support has a large end supporting an associated lens and a small end secured to the substrate and surrounding an associated light emitting diode. In this manner light from the light emitting diodes is focused by the lenses and projected to a patient for operating and examination purposes.

A protective cover 18 is next provided. The cover is fabricated of a translucent material. A central portion in an rectangular configuration overlies the central section of the substrate. Four side portions couple the central portion to the substrate. The side portions include two parallel long side portions with two parallel short side portions there between. The side portions have a common height sufficient to allow the protective cover to totally encompass all of the light emitting diodes and their lenses and supports.

Next provided is a pair of laterally disposed cut out portions 24 formed as extensions of the central section of the substrate adjacent to the two short side portions adapted to function as handles.

An articulated arm 22 is next provided. The articulated arm extends in a generally vertical orientation during operation and use. The arm has an upper end and a lower end. The articulated arm includes a horizontal extension coupling the upper end of the articulated arm and the rear face of the substrate. The articulated arm also includes a disc shaped magnet pivotally coupled to the lower end of the articulated arm.

In the primary embodiment, the focusing means includes a lens for each light emitting diode and the light emitting diodes and lenses are in even rows and columns. Note FIGS. 1, 2 and 3.

Figure 4:
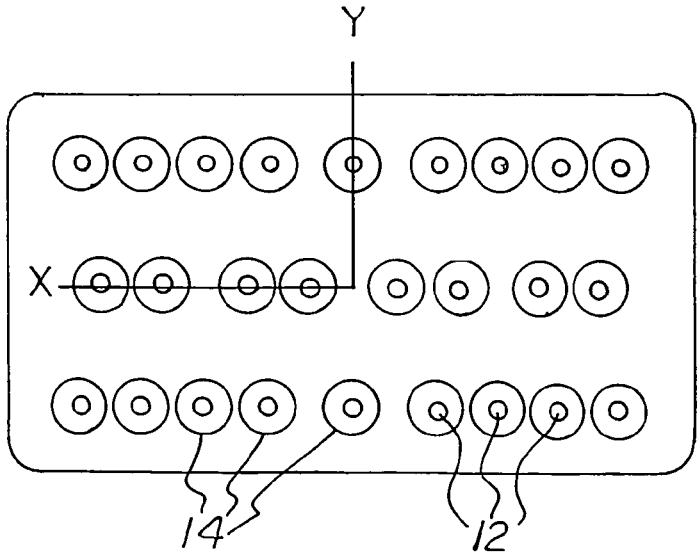
FIG. 4 is a front elevational view of Light emitting diodes and lenses of the type use in FIGS. 1 and 2 but in an alternate non-symmetric orientation.

In an alternate embodiment of the invention, shown in FIG. 4, the focusing means includes a lens for each light emitting diode and wherein the light emitting diodes and lenses are in uneven rows and columns.

These embodiment of the LED operating and examination light system 10 comprises a plurality of LEDs 12 with individual collimating lenses 14. See FIGS. 1, 2 and 4. FIG. 1 shows a plurality of LEDs 12 mounted on heat dissipating substrate 16 having a translucent or transparent protective cover 18 and forming a light head 20. FIGS. 2 and 3 show the light head 20 attached to an articulated arm 22 for manual manipulation. Manipulation of the light is achieved by grasping one or both of the hand grip cutout portions 24 and aiming the light. The quantity of LEDs 12 and lenses 14 depends greatly on the state-of-the-art of LED technology. At present a suitable LED operating and examination light system 10 will require about 26 Lumileds brand white LEDs to achieve adequate lighting levels. A rendering of this concept is shown in FIG. 4. Optical modeling results for the 26 LED system are shown in FIGS. 5 and 6. The illumination produced at 24 inches is seen to cover a roughly rectangular field for the LED pattern shown.

In an alternate embodiment, the light emitting diodes 32 are mounted on a thermally conductive plate 34 with a longitudinal bend 36. In this embodiment, the focusing means includes a parabolic trough reflector 40 in a semi-circular cross sectional configuration and parallel side panels 42 support the plate at its ends. Note FIGS. 8 and 9.

Figure 10:
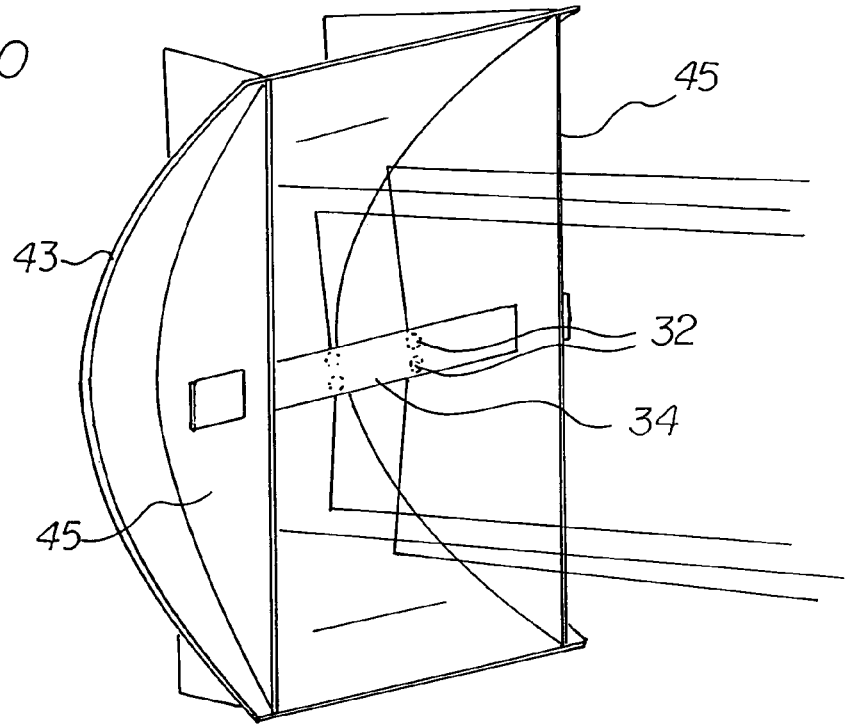
FIG. 10 is perspective illustration of the Light emitting diode operating and examination light system shown in FIG. 8 but mounted in a reflector with angled sides.

In another embodiment, the light emitting diodes 32 are mounted on a thermally conductive plate 34 with a longitudinal bend 36 and the focusing means includes a parabolic trough reflector 43 in a semi-circular cross sectional configuration. Angled side panels 45 support the plate at its ends. Note FIG. 10.

Figure 8:
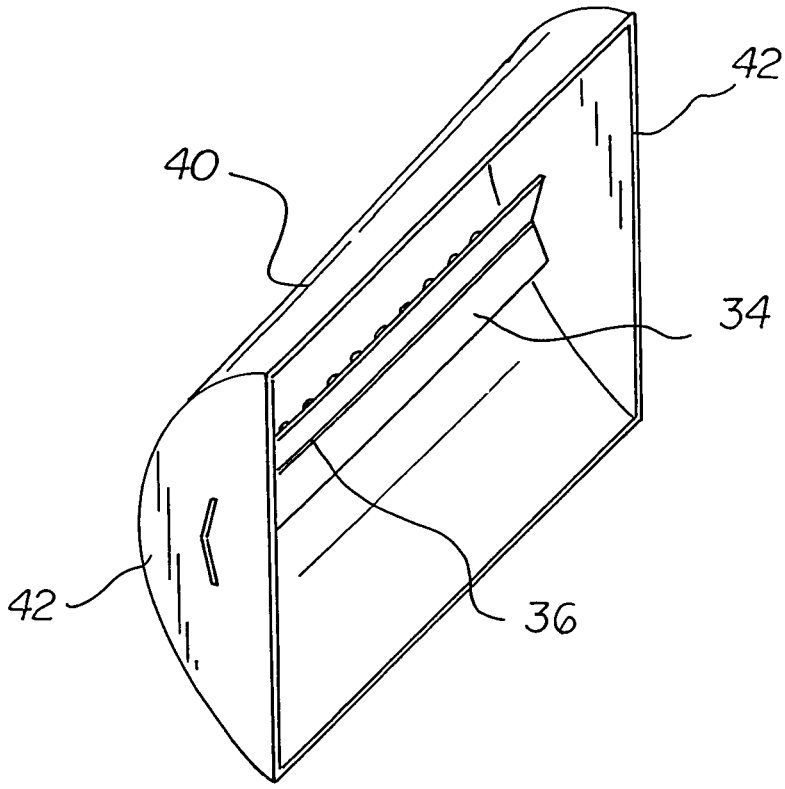
FIG. 8 is perspective illustration of the Light emitting diode operating and examination light system shown in FIG. 7 but mounted in an semicircular reflector.
Figure 9:
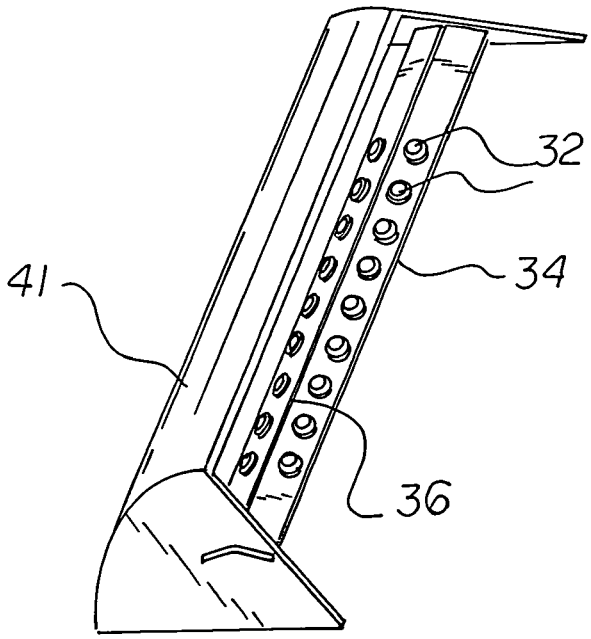
FIG. 9 is a cutaway illustration of the Light emitting diode operating and examination light system shown in FIGS. 7 and 8.
Figure 11:
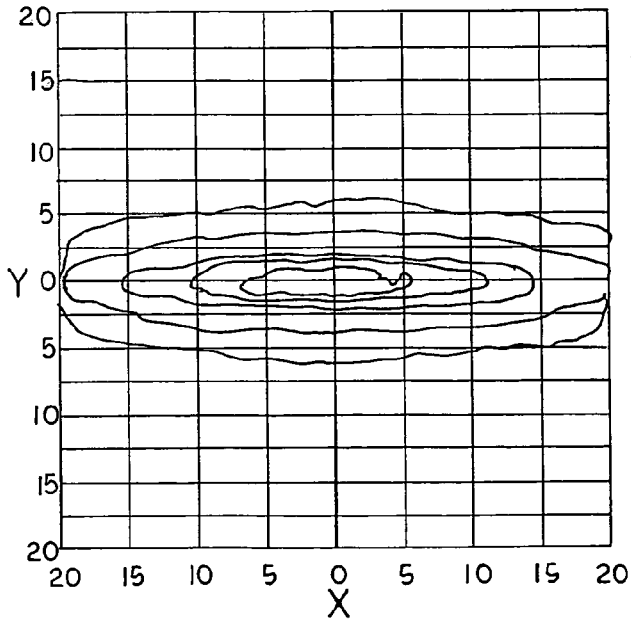
FIG. 11 is a graph showing the dispersion of light from the Light emitting diodes of FIG. 10 following its associated reflector.
Figure 12:
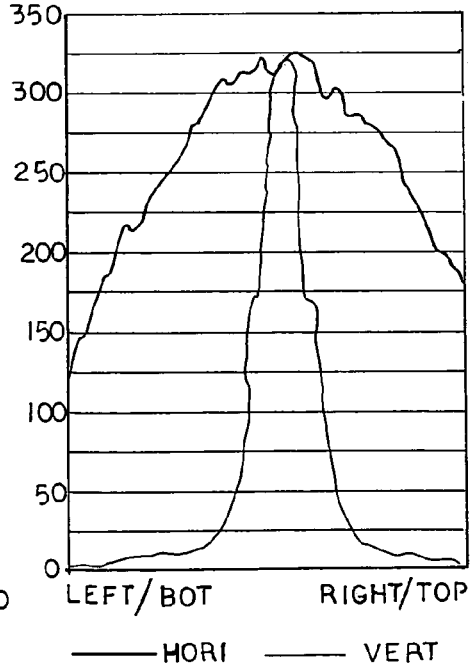
FIG. 12 is a graph showing the magnitude of the light output from the Light emitting diodes of FIG. 10 following its associated reflector.

These embodiments of the LED operating and examination light system 30 comprise a plurality of LEDs 32 affixed to an extended thermally conductive plate 34. See FIGS. 7 through 10. Although plate 34 may be flat, optical output uniformity and intensity is enhanced by forming plate 34 with one or more longitudinally disposed bends 36 to direct the dominant light output from LEDs 32. FIGS. 7, 8 and 9 show a parabolic trough reflector 40 with LEDs 32 and plate 34. Such Figures show a view illustrating the disposition of the LEDs 32 on the plate 34 in the reflector 40. Plate 34 with LEDs 32 affixed thereto is positioned at the focal line of parabolic trough reflector 40 causing a maximal amount of light from LEDs 32 to reach reflector 40. Reflector 40 collimates light from LEDs 32 and produces a generally rectangular beam profile with minimal divergence. Reflective side panels 42 are angled or may be curved to further concentrate LED light thereby producing uniform illumination of a subject. FIGS. 11 and 12 show the optical model and illuminance for this system.

Figure 13:
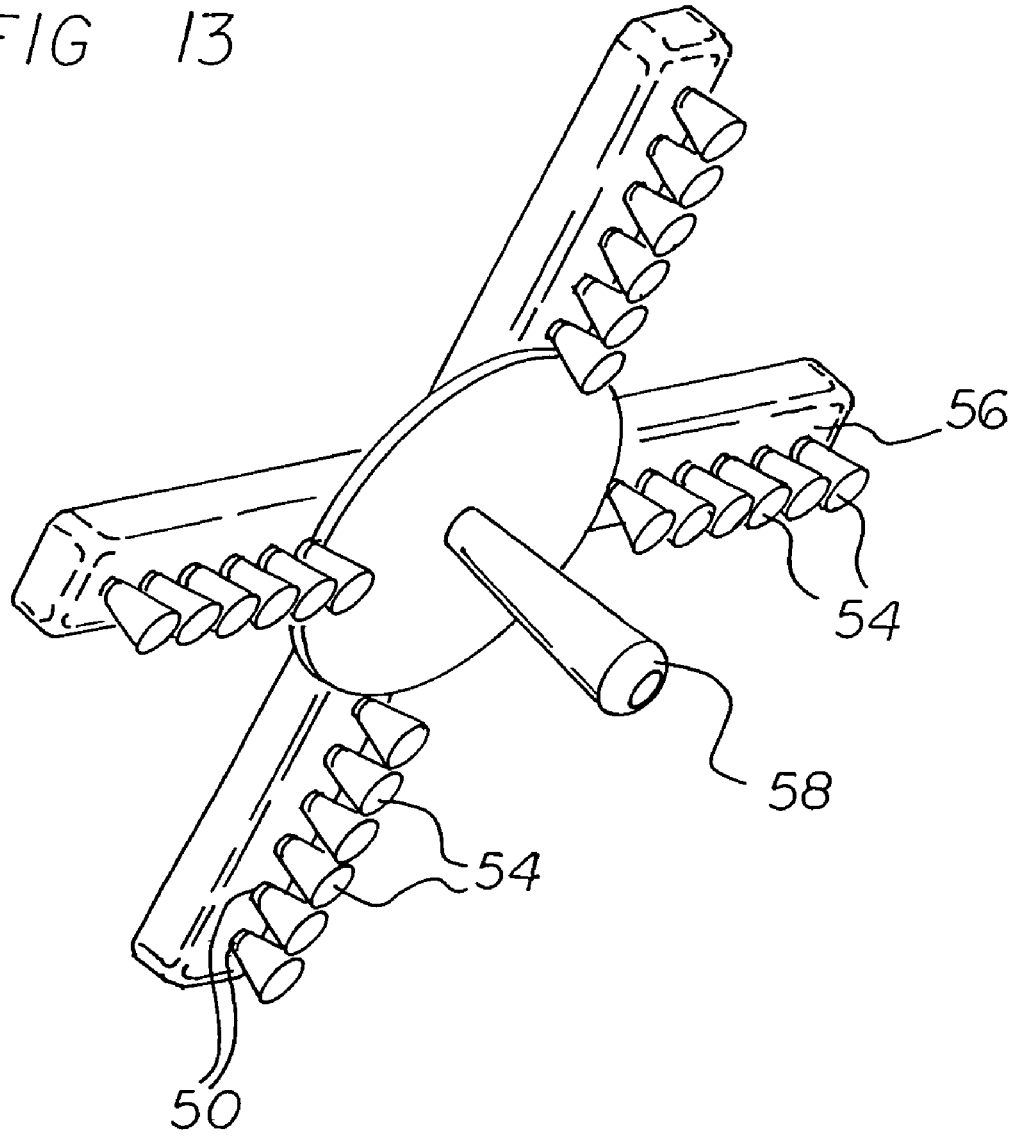
FIG. 13 is a perspective illustration of a LED operating and examination light system constructed in accordance with a final alternate embodiment of the present invention.

In a final embodiment of the invention, the focusing means includes a lens 54 for each light emitting diode 56 and the light emitting diodes and lenses are supported in a cross shaped configuration with a handle 58 centrally oriented with respect to the light emitting diodes and lenses. Note FIG. 13.

In this final embodiment of the invention, a plurality of LEDs 50 each having a collimating lens 54 producing a beam of light between 4 degrees and 10 degrees angular spread are mounted on a thermally conductive printed circuit substrate 56 such as JP-Clad and positioned in an array to illuminate a wide area at a range of separation distances extending from about 24 inches to about 54 inches. Handle 58 is used to manually direct the light output to illuminate the subject as required. See FIG. 13 which shows a rendered version of this embodiment.

All of the embodiments of the present invention include plurality of LEDs powered by application of electrical current in combination with a plurality of lens systems communicating with each LED where each lens system is susceptible to collecting light from said LEDs and collimating said LED light into beams diverging by not more than 20 degrees, and in further combination with aiming means for directing the light output of the lens systems. In the embodiment of FIGS. 1 through 4, the LEDs and lens systems produce a beam of light having a luminance preferably not less than 500 foot-candles at a distance of 24 inches. In these embodiments, the LEDs and lens systems produce a beam of light having a well defined illuminated area not less than 20 square inches in area and not more than 350 square inches in area at a distance of 24 inches.

In the embodiment of FIGS. 7 through 10, the LEDs and lens systems produce a beam through a parabolic trough reflector susceptible to receiving light from said LEDs and projecting the light into a well defined region not less than 20 square inches in area and not more than 350 square inches in area at a distance of 24 inches.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A light emitting diode, LED, operating and examination light system for illuminating an area on a subject for the performance of a medical operating procedure and medical examination with minimum heat generated and energy required in association with maximum efficiency comprising, in combination:

a plurality of circular light emitting diodes with a circular focusing member positioned at a fixed common distance adjacent to each light emitting diode and a substrate in a common plane with a rear face and a parallel front face, the front face having a central section in a generally rectangular configuration securing the diodes in a common plane and forming rows and columns;

a plurality of focusing member supports, each support having a circular large end supporting an associated lens and a circular small end secured to the substrate and surrounding an associated light emitting diode, whereby light from the light emitting diodes is focused by the focusing member and projected to a patient for operating and examination purposes;

a protective cover fabricated of a translucent material with a central portion in an rectangular configuration overlying the central section of the substrate and four side portions at right angles to the central portion and coupling the central portion to the substrate, the side portions including two parallel long side portions with two parallel short side portions there between, the side portions having a common height sufficient to allow the protective cover to be spaced above the substrate and to totally encompass all of the light emitting diodes and their lenses and supports;

a pair of laterally disposed cut out portions formed as extensions of the central section of the substrate adjacent to the two short side portions adapted to function as handles; and an articulated arm extending in a generally vertical orientation during operation and use with an upper end and a lower end, the articulated arm including a horizontal extension coupling the upper end of the articulated arm and the rear face of the substrate, and the articulated arm also including a pivotally coupling means affixed to the lower end of the articulated arm.

* * * * *